United States Patent [19]

Dirks et al.

[11] 4,296,553

[45] Oct. 27, 1981

[54] PORTABLE POWER CHAIN SAW

[75] Inventors: Rudolf Dirks, Weinstadt-Schnait; Karl Nitschmann, Schorndorf, both of Fed. Rep. of Germany

[73] Assignee: Adreas Stihl, Waiblingen, Fed. Rep. of Germany

[21] Appl. No.: 95,053

[22] Filed: Nov. 16, 1979

[30] Foreign Application Priority Data

Mar. 23, 1979 [DE] Fed. Rep. of Germany ..... 2911498

[51] Int. Cl.[3] ..... B27B 17/00

[52] U.S. Cl. ..... 30/381

[58] Field of Search ..... 30/381, 382, 383, 384, 30/385, 386

[56] References Cited

U.S. PATENT DOCUMENTS

| | | | |
|---|---|---|---|
| 3,728,793 | 4/1973 | Makinson | 30/383 |
| 4,041,606 | 8/1977 | Thompson | 30/381 |
| 4,138,812 | 2/1979 | Zimmerer | 30/381 |

*Primary Examiner*—Jimmy C. Peters

*Attorney, Agent, or Firm*—Becker & Becker, Inc.

[57] ABSTRACT

A portable power chain saw with at least one grip for carrying the saw which grip is attached by interpositioning of at least one vibration attenuating member and attachment parts to the motor housing of the saw. The grip and the housing are connected to one another with at least one support part associated with said journal being provided.

21 Claims, 5 Drawing Figures

PORTABLE POWER CHAIN SAW

The present invention relates to a portable power chain saw with at least one handle or grip for carrying the saw; the handle is attached to the motor housing by interpositioning of at least one vibration attenuating member and attachment parts.

In a known saw of this type, the ends of the handle or the grip are respectively connected to the housing by interpositioning of one dampening element to avoid transfer of motor vibrations to the handle and, thus, to the hands of the operator carrying the saw. The dampening elements are resilient rubber plugs which are arranged in the direction transverse to the longitudinal direction of the implement and are arranged considerably to the outside thereof. A danger exists that the rubber plugs break due to this positioning accompanied by attendant mechanical demands made on the chain saw in the event of overloading as well as the resultant shear stresses acting on the rubber plugs, and also because the rubber plugs are subjected to dirt in the form of oil, gasoline, and the like. The connection between the motor and the associated ends of the handle is then disrupted; this leads to a diminishing of the capacity to properly guide the power chain saw; also, such guiding capacity may be fully lost. Thus, the possibility increases that accidents can occur.

It is an object of the present invention to provide a power chain saw which can be sufficiently securely guided even when the dampening element has become worn out.

This object and other objects and advantages of the invention will appear more clearly from the following specification in connection with the accompanying drawings, in which.

Figure 1:
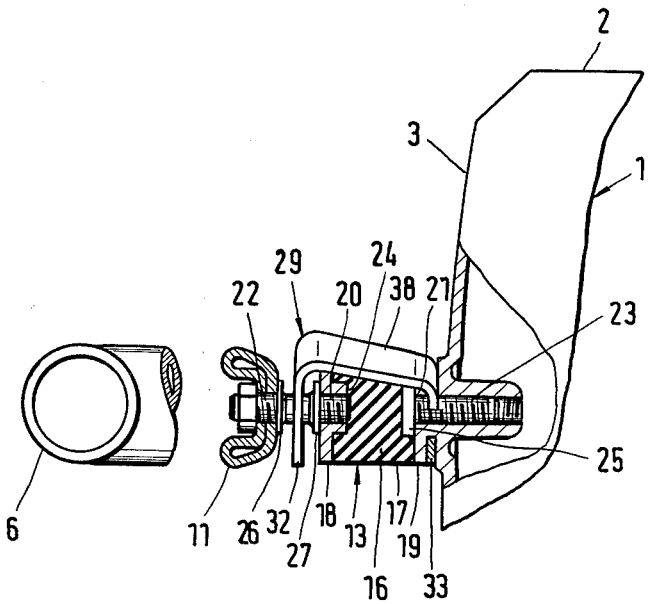
FIG. 1 is a top plan view, partly in section, of a forward, transverse, handle secured to the housing of a power chain saw in accordance with one embodiment of the present invention.

A power chain saw in accordance with the present invention is characterized primarily therein that the grip or grips and the housing are connected to one another by interpositioning of at least one support part associated with the vibration dampening element belonging therewith.

The support part provides for protection of this vibration attenuating means, which serves for attenuation of vibrations when the motor of the saw is running. The support part assures the integrity of the connection between the grip and the motor (or the housing) when the vibrating attenuating means has become damaged or is destroyed. The grip is then, nevertheless, securely connected to the motor so that the saw can be guided by the operator. Thus, despite loss of the vibration attenuating means, a sufficient positive guiding of the saw is assured and an imminent danger of an accident occurring is avoided.

In accordance with a preferred embodiment of the invention, the support part extends between the housing and the grip, preferably substantially parallel to the direction of the axis of the vibration attenuating means. At least one plug-in opening is associated with the support part, whereby the opening with a predetermined degree of clearance surrounds a plug-in component, or securement member belonging therewith. The opening and the securement member belonging therewith provide an overload protection for the dampening member. The support part is preferably a bent member which extends around the vibration attenuating means, or dampening member; this bent member can be approximately U-shaped whereby its two legs extend substantially parallel to the housing and/or the handle.

It is preferred that the openings for securing the members are arranged in the legs of the U-shaped bent part and that these members are provided by the attachment parts for the vibration attenuating means.

In accordance with another preferred embodiment, the securement members are screws by means of which the vibration attenuating means are secured to the grip and the housing.

In accordance with another preferred embodiment, the securement members are screwed into discs, preferably metal discs of the dampening members; these discs are connected to one another by interpositioning of a substantially cylindrical elastic base body, preferably of elastomeric material.

It is also preferred that the bent part is secured with one leg so as to be fixedly clamped between the housing and/or the handle and the dampening member; this fixedly clamped leg forms the one disc of the dampening member. The other leg of the bent member is arranged having an axial distance or spacing from the dampening member and the handle and/or the housing. This movably arranged leg is arranged between two shoulders which are arranged from one another having a predetermined axial spacing, and between the attachment part belonging therewith so that one shoulder is supported on the grip and/or the housing and the other shoulder is supported on the dampening member.

In accordance with another preferred embodiment of the invention, the effective size of the opening of the movably arranged leg is greater than the diameter of the shoulders of the securement members. Preferably, the shoulder which is in contact with the grip and/or the housing is of greater diameter than the other shoulder.

In accordance with another embodiment of the invention, the legs of the bent member are of different lengths and the connecting or crosspiece thereof extends in an arrangement approximately parallel, preferably at a small inclination, to the longitudinal central axis of the dampening member; this arrangement exists in such a way that the crosspiece and the movably arranged leg form an abutment or stop for the dampening member at the maximum permissible oscillation of vibration. It is preferred that the height of the short, fixedly secured leg is approximately equal to the diameter of the base body of the dampening member. It is furthermore preferred that the support part forms the securement member. Also, still further preferred is that the support part is located at a small distance away from the dampening member, when viewed in the longitudinal direction of the saw.

It is also preferred that the support part is a projection which extends outwardly from the housing; this projection extends into an opening of the grip belonging therewith. Accordingly, it is also preferred that the opening is provided by a profile-opening of the handle or grip.

Figure 4:
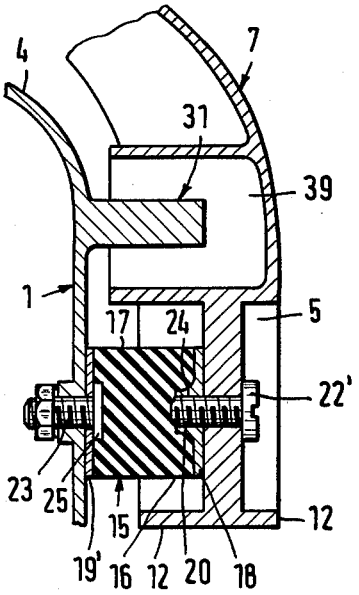
FIG. 4 is a view substantially in cross section showing the housing of the power chain saw with the transverse handle on the side opposite to that indicated in FIG. 1.
Figure 5:
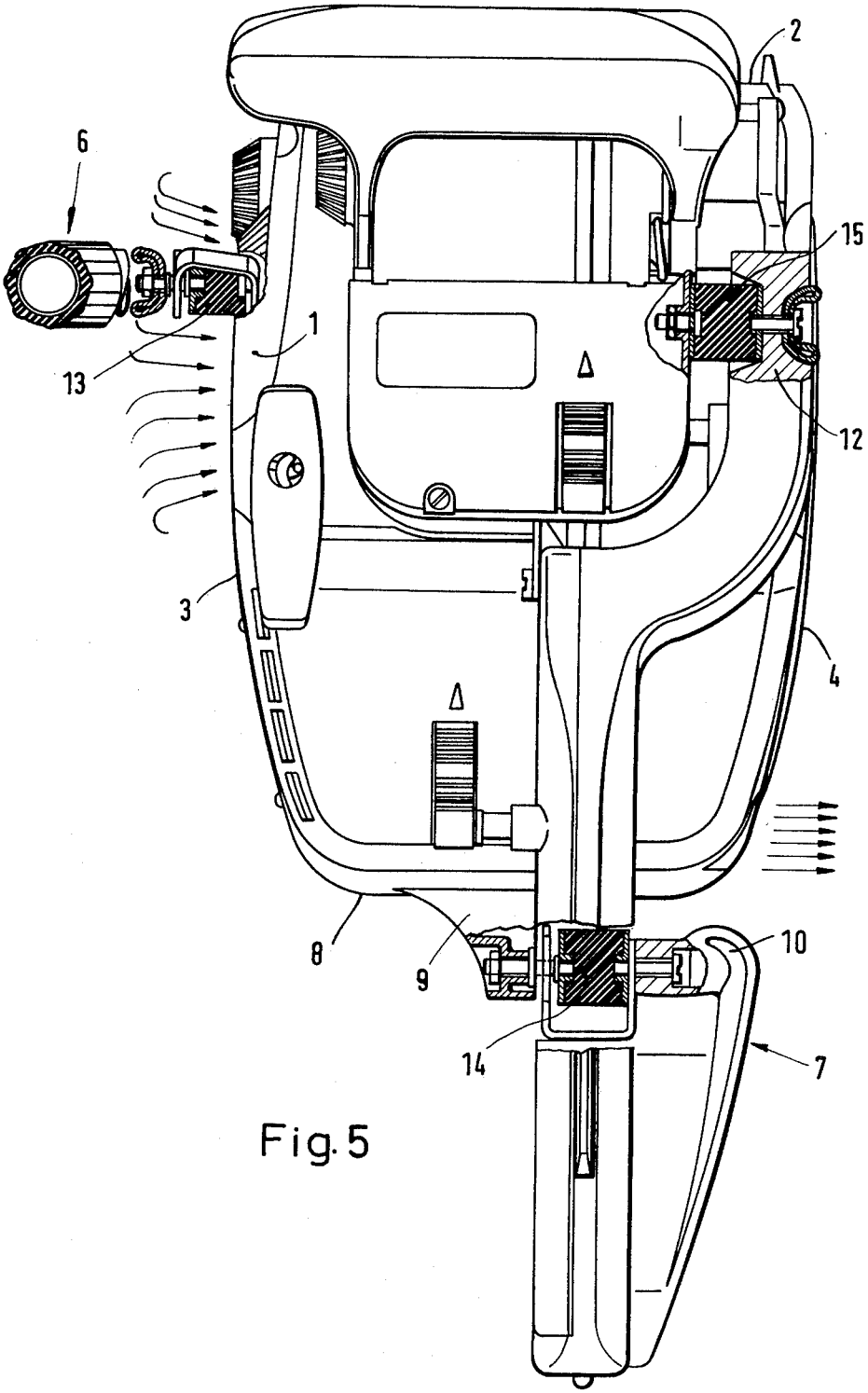
FIG. 5 is a top plan view, partly in cross section, of a power chain saw in accordance with an embodiment of the present invention.

Referring now particularly to the drawings in detail, the power chain saw, preferably a portable power chain saw, includes a housing 1 for a motor, especially a two-stroke internal combustion engine. At the forward side 2 of housing 1 there is arranged, but not shown in the drawings, a guide rail or bar with an associated housing for the cutting chain of the saw. In the forward housing part at the housing sides 3 and 4, respectively, there is arranged a U-shaped transverse handle or grip 6 which extends perpendicular to the longitudinal central axis of the saw. The end 11 of the long leg of this handle or grip 6 is secured to the housing side 3, and the short leg extends into an opening or aperture 5 of a forward end 12 of a second grip or handle 7 belonging therewith (FIG. 4).

This second handle 7 is secured with its forward end 12 on housing side 4 and extends approximately parallel to the longitudinal central axis of the housing 1. The second handle 7 extends with an approximately V-shaped curved end-part over the rearward side 8 of the housing where it is secured with its free end 10, particularly to a projection 9.

The two handles or grips 6 and 7, respectively, are resiliently supported on the housing 1 with their ends 10, 11 and 12; respectively, by interpositioning of a dampening element 13, 14, 15. Consequently, vibrations caused due to the running of the motor are not transmitted to the handles 6 and 7, and from these handles to the hands of the operator of the saw. The dampening members or elements 13, 14 and 15 provide vibration dampening or attenuating means comprising a base body 16 of rubber or similar elastomeric material. The base body 16 has a cylindrical outer surface 17. At the ends of the base body 16 there are provided end plates or discs 18 and 19 of approximately the same outer diameter as the base bodies 16. Concentrically to the axis of each base body 16 there are arranged openings 20 and 21 in the discs 18, 19, 19' and 19'' for the securement or attachment elements or members 22, 22' and 23, 23' belonging therewith.

In the embodiments shown, the securement members are in the form of screws. In accordance with FIGS. 1 and 4, respectively, there is provided a collar screw 23 which is supported with its collar or shoulder 25 on the inner side of the metal discs 19, 19'' belonging therewith. For attaching to the handle 6 or 7, respectively, in accordance with FIG. 1, there is also provided a collar screw 22 which is outwardly in contact with a collar or shoulder 26 with the handle 6 and with a second collar or shoulder 27 outwardly on the metal plate or disc 18. In accordance with FIG. 4, the dampening element 15 is arranged with a flat head screw 22' at the handle 7. Both screws 22 and 22' are screwed with their ends in the openings or bores 20 which are furnished for this purpose with threaded portions 24 extending into the base body 16 belonging therewith.

A corresponding collar screw 23', as shown in FIG. 1, and a similar flat head screw 22', as shown in FIG. 4, are provided for connecting the rearward end 10 of the handle 7; these screws are arranged between the dampening element 14 and the projection 9 and between the dampening or attenuating element 14 and the handle proper. In the embodiment according to FIG. 3, handle 6 is connected to the dampening member 13' by means of a collar screw 22, as was the case in the embodiment according to FIG. 1, and the housing 1 is connected to the dampening member 13' by means of a flat head screw 23' in accordance with the embodiment of FIGS. 2 and 4.

The connection or securement thus provided between the housing and the ends of the handles belonging therewith; this connection is assured also when the dampening elements 13, 14, 15 and 13' are worn or damaged, in accordance with the present invention, by the support parts 29, 30, 31, and 29' which are provided to bridge the distance between the housing 1 and the grips 6 and 7, respectively. Thus, even in the absence of a worn or fractured dampening element, i.e. due to wear thereof, there is nevertheless provided a connection between the housing and the grips or handles belonging therewith.

Figure 2:
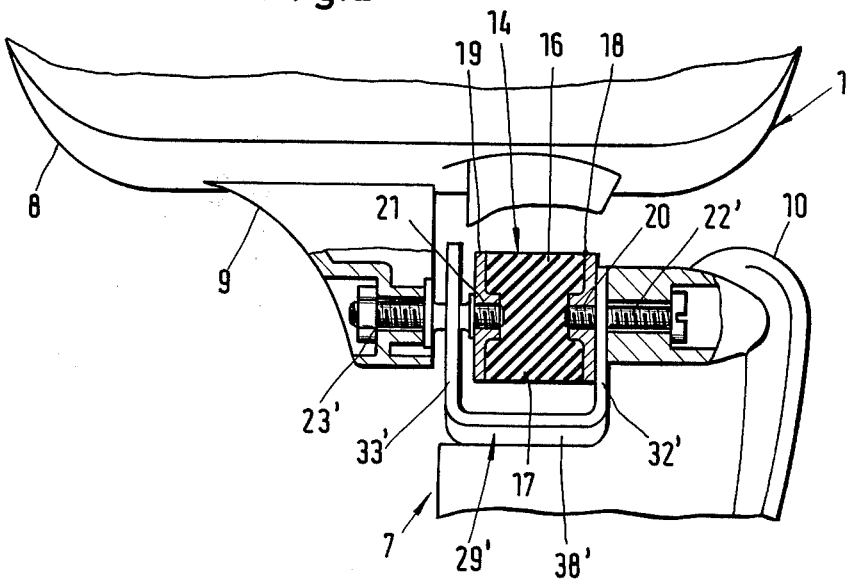
FIG. 2 is a view corresponding to FIG. 1 of a longitudinal grip secured to the back side of a power chain saw in accordance with an embodiment of the present invention.
Figure 3:
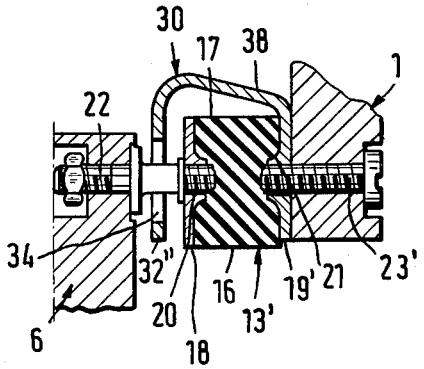
FIG. 3 shows a further embodiment of the connection between the handle and the housing of a power chain saw in accordance with the present invention.

According to the embodiments shown in FIGS. 1, 2 and 3, the support parts or protective elements or links 29, 29' and 30 are in the form of bent members with the legs 32, 32', 32'' and 33, 33', and 19' thereof being adapted to receive the attachment or securement parts or members i.e. screws 22, 22', 23 and 23'. These are inserted into the legs belonging therewith. Passages or holes 34 and 21 are arranged for receiving of the thus formed securement members 22, 22' and 23 in the legs 32, 32', 32'', 33, 33', and 19' respectively. The width of effective openings of the passages 34 and 21 for the collar screws 22, 23, 23' is respectively greater than the diameter of the screws and the collars or shoulders 25, 26 and 27. Thus, the screws are arranged with a clearance in the openings and they can be moved, or pushed as it were, with their heads through the openings. On the other hand, these passages can be adapted to the diameter of the screw or screws belonging therewith, when the legs 33, 32' and 19' are secured between the housing 1 and/or handle 7 (FIG. 2) and the dampening element 13, 13' and 14. The free legs 32, 32' and 32'', however, are provided, relative to the screws 22, 23' belonging therewith and having such a clearance or play, that the balancing movements attendant during operation, between housing 1 and the ends 10 and 11 of the handles 6 and 7, respectively, are not prevented. On the other hand, the clearance is to be such that the dampening elements 13, 13' and 14 are positively held or limited in their movement by the support parts or bent members 29, 29', and 30. At maximum oscillation or swinging of the dampening elements, contact between the screws and the walls of the passages can occur whereby overstrain of the vibration dampening bearings or elements is avoided. Since the bent members 29, 29' and 30 are at a distance away from the collars or shoulders 26 and 27 of the screws 22 and 23', also axial movements of the dampening elements 13, 13', and 14 are not prevented. The annular shoulders 26 and 27 assure, furthermore, a secure support, over the effective surface area of the screws belonging therewith at the housing 1 and/or handle 6 and at the dampening elements 13, 13', and 14. The housing, the handle, and the discs are thus primarily protected against damage moreover, since the discs, which are in contact with the housing and the handle, have a greater diameter.

The bent members 29 and 29' according to FIGS. 1 and 2, due to their particular configuration of the dampening elements 13 and 14 can be installed subsequently into existing tools without problems in order to provide the desired protection for the dampening elements. This is feasible by replacement of the damping element in the case of a bent member 30, which is integral with a metal disc 19' (FIG. 3). Since only one metal plate is required, less costs arise for the second metal disc and space is saved for this disc or plate. The simple bent members do not lead to a great increase of cost of the tool and, furthermore, can be arranged in a space-saving manner.

In the case of the approximately U-shaped bent members 29 and 30, the transverse member or crosspiece 38 extends oblique, preferably at a small inclination relative to the longitudinal central axis of the dampening elements 13, 13'. This inclination can be selected in such a way that the crosspieces or transverse members with the legs 32 and 32'' provide a limit of movement or stop for the dampening elements. Thus, the free or unrestrained legs 32 and 32'' are protected against bending or similar damage and the impact of a broken dampening element part can be reduced. However, even when extending approximately parallel to the longitudinal central axis of the dampening element, a transverse member or crosspiece 38' can contribute to the limit of movement.

In the embodiment according to FIG. 4, the support part or member 31 is provided by a pin-shaped projection of the housing 1; this projection extends into the handle opening 39 of the handle 7 belonging therewith. This support member 31 is positioned at a small distance behind the dampening element 15 which is tensioned in contact with its two metal discs 18 and 19'' at the housing and/or the handle 7. The pin or projection 31 extends with a circumferential play into the opening 39, whereby the opening 39, corresponding to the legs of the bent members according to FIGS. 1–3, serves as limit of the movement of the dampening element 15. Thus, the support member connection not only provides a protection which upon breakage of the dampening element prevents that the handle end is not directly secured to the housing, but it also serves simultaneously as an overload protection for the dampening element.

In the embodiment, this opening 39 in the handle is unitary or integral with the handle being produced as a profilepart. The opening can also be provided by a separate part such as a ring, bushing, or the like, secured to or inserted in the handle. In any event, the clearance between the support part and the opening belonging therewith should be selected such that a limit of movement for the dampening element is present. The pin 31 extends substantially over its full length and deep into the opening 39, in such a way that in the event the dampening element 15 should break, and relatively high forces are present, the pin cannot inadvertently slip out of the opening whereby the connection between the housing and the handle would be lost.

This protection (FIG. 4) is selected primarily where the space is fairly crowded because under these circumstances between the housing and the handle there needs to be available only a distance corresponding to the axial extent of the dampening element.

The present invention is, of course, in no way restricted to the specific disclosure of the specification and drawings, but also encompasses any modifications within the scope of the appended claims.

What we claim is:

1. A portable power chain saw, comprising in combination:

a housing;

at least one grip including an end for connection and operatively connected to said housing;

vibration attenuating means for each grip connection having a longitudinal central axis as well as being arranged between the end of a grip and said housing;

a support part operatively connected to said housing and the end of said grip belonging therewith for each grip connection as well as being exchanged and installed subsequently for the motor chain saw without great cost and complexity, said support part extending between said housing and a grip belonging therewith, said support part extending generally parallel to the longitudinal central axis of said vibration attenuating means;

at least one of said support part and said housing including an opening, and a securing member inserted in said opening with play and serving to limit movement of said support simultaneously as overload protection for said vibration attenuating means.

2. A chain saw in combination according to claim 1, wherein said support part is a bent member adapted to partly surround a vibration attenuating means belonging therewith.

3. A chain saw in combination according to claim 2, wherein said bent member is U-shaped and has a first leg and a second leg, said legs extending generally parallel to at least one of said housing and a grip belonging therewith.

4. A chain saw in combination according to claim 3, wherein each leg of said U-shaped member has an opening, and further comprising said securing member insertable, with play, in openings of a pair of first and second legs, with each securing member also supporting a means for attenuating vibrations.

5. A chain saw in combination according to claim 4, wherein said securing member includes a screw for operatively connecting said vibration attenuating means between said housing and a grip therewith.

6. A chain saw in combination according to claim 5, wherein said vibration attenuating means includes a cylindrical body of elastomeric material including end therewith.

7. A chain saw in combination according to claim 6, wherein said elastomeric material is rubber.

8. A chain saw in combination according to claim 6, wherein discs reinforce the ends of said cylindrical body, said discs being threadingly connected to said screws.

9. A chain saw in combination according to claim 4, wherein said first leg of said bent member is fixedly secured between a vibration attenuating means and one of said housing and a grip belonging therewith.

10. A chain saw in combination according to claim 9, wherein said vibration attenuating means is a cylindrical body of elastomeric material and said fixedly secured first leg provides said reinforcing disc of an end of said cylindrical body therewith.

11. A chain saw in combination according to claim 9, wherein the second leg of said bent member is arranged with clearance from one of said housing and a grip and from a vibration attenuating means belonging therewith.

12. A chain saw in combination according to claim 11, wherein said securing member has a first shoulder and a second shoulder axially spaced from said first shoulder, with a second leg of said bent member belonging therewith being arranged with clearance between said first and second shoulders, said first shoulder being supported by one of a grip and said housing, and said second shoulder being supported by vibration attenuating means.

13. A chain saw in combination according to claim 11, wherein said opening in said second leg has a diameter which is greater than the diameter of said first and second shoulders.

14. A chain saw in combination according to claim 13, wherein the diameter of said second shoulder is greater than the diameter of said first shoulder.

15. A chain saw in combination according to claim 14, wherein said first and second legs have different lengths and a crosspiece of said U-shaped therewith extends approximately parallel to the longitudinal central axis of said vibration attenuating means in such a way that said crosspiece and said second leg provide an abutment for said vibration attenuating means at maximum permissible oscillations of vibrations.

16. A chain saw in combination according to claim 15, wherein said crosspiece extends at a slight angle to the longitudinal central axis of said vibration attenuating means.

17. A chain saw in combination according to claim 13, wherein said vibration attenuating means is a cylindrical body of elastomeric material, and wherein the length of said first leg is less than the length of said second leg, with the length of said first leg corresponding approximately to the diameter of said cylindrical body.

18. A chain saw in combination according to claim 1, wherein said support part is adapted to act as a securing member.

19. A chain saw in combination according to claim 18, wherein said support part, when viewed in the longitudinal direction of said saw is spaced from said vibration attenuating means.

20. A chain saw in combination according to claim 19, wherein said support part is a stop extending from said housing and is received in said opening of a grip belonging therewith.

21. A chain saw in combination according to claim 20, wherein said opening is provided by a profile-depression of a grip belonging therewith.

* * * * *